US010494699B2

(12) United States Patent
Wang et al.

(10) Patent No.: US 10,494,699 B2
(45) Date of Patent: Dec. 3, 2019

(54) METHOD OF REFINING ALUMINUM ALLOY

(71) Applicants: CITIC Dicastal CO., LTD, Qinhuangdao (CN); Hebei University of Technology, Tianjin (CN)

(72) Inventors: Lisheng Wang, Qinhuangdao (CN); Yongning Wang, Qinhuangdao (CN); Zhihua Zhu, Qinhuangdao (CN); Chunhai Liu, Qinhuangdao (CN); Changhai Li, Qinhuangdao (CN); Lateng A, Qinhuangdao (CN); Zhendong Zhang, Qinhuangdao (CN); Bangwei Bai, Qinhuangdao (CN); Weimin Zhao, Qinhuangdao (CN); Zhifeng Wang, Qinhuangdao (CN)

(73) Assignees: CITIC DICASTAL CO., LTD., Qinhuangdao (CN); Hebei University of Technology, Tianjin (CN)

( * ) Notice: Subject to any disclaimer, the term of this patent is extended or adjusted under 35 U.S.C. 154(b) by 802 days.

(21) Appl. No.: 15/072,085

(22) Filed: Mar. 16, 2016

(65) Prior Publication Data

US 2016/0273076 A1 Sep. 22, 2016

(30) Foreign Application Priority Data

Mar. 19, 2015 (CN) ..... 2015 1 0120867

(51) Int. Cl.
*C22C 1/06* (2006.01)
*C22F 1/04* (2006.01)
(Continued)

(52) U.S. Cl.
CPC ..... *C22C 1/06* (2013.01); *B22D 1/00* (2013.01); *B22D 21/04* (2013.01); *B22D 45/00* (2013.01);
(Continued)

(58) Field of Classification Search
CPC ..... C22C 1/06
(Continued)

(56) References Cited

FOREIGN PATENT DOCUMENTS

| | | |
|---|---|---|
| CN | 102886511 | 1/2013 |
| CN | 103589916 | 2/2014 |
| CN | 103667759 | 3/2014 |

OTHER PUBLICATIONS

Inoue et al. "High Mechanical Strength of Quasicrystalline Phase Surrounded by fee-Al Phase in Rapidly Solidified Al—Mn—Ce Alloys." Materials Transactions, JIM, vol. 33, No. 8 (1992), pp. 723 to 729. (Year: 1992).*

* cited by examiner

*Primary Examiner* — Brian D Walck
(74) *Attorney, Agent, or Firm* — Hamre, Schumann, Mueller & Larson, P.C.

(57) ABSTRACT

The invention provides a method of refining aluminum alloy, which is characterized in that aluminum-based nanometer quasicrystal alloy is used as an aluminum alloy refiner to refine the aluminum alloy; the aluminum-based nanometer quasicrystal alloy does not comprise Si, Fe or Cr; the aluminum-based nanometer quasicrystal alloy consists of (1) Al; (2) Mn and (3) La and/or Ce. The refiner selected in the invention is rare earth-containing alloy which has a strong refinement ability on the aluminum alloy, and is nanometer quasicrystal; after adding the rare earth-containing alloy to melt, the element distribution of the rare earth-containing alloy is more uniform than that of traditional alloy; and nanometer quasicrystal particles substantially increase the number of heterogeneous nucleation particles and improve the grain refinement effect of the aluminum alloy.

5 Claims, 3 Drawing Sheets

(51) Int. Cl.

| | |
|---|---|
| ***C22C 21/00*** | (2006.01) |
| ***B22D 45/00*** | (2006.01) |
| ***B22D 1/00*** | (2006.01) |
| ***B22D 21/04*** | (2006.01) |
| ***C22B 21/06*** | (2006.01) |
| ***C22C 1/02*** | (2006.01) |

(52) U.S. Cl.
CPC ..... *C22B 21/06* (2013.01); *C22C 1/026* (2013.01); *C22C 21/00* (2013.01); *C22F 1/04* (2013.01)

(58) Field of Classification Search
USPC ..... 148/549
See application file for complete search history.

METHOD OF REFINING ALUMINUM ALLOY

FIELD OF THE INVENTION

The invention relates to aluminum alloy smelting field and, more particularly, to a method of refining aluminum alloy.

BACKGROUND OF THE INVENTION

A356.2 aluminum alloy has excellent characteristics such as good flowability, no tendency of hot cracking, low linear shrinkage, small specific gravity, good corrosion resistance, and is the material mainly used in automobile hubs. However, as-cast structure of the A356.2 aluminum alloy without being subjected to refinement and modification treatment is a coarse sheet-like or needle-like eutectoid silicon and alpha-Al dendritic structure with relatively low mechanical properties. Therefore, it is necessary to add modification elements and grain refining elements so that morphology of the eutectoid silicon is transformed from the coarse sheet shape or needle shape into a fine spherical shape or rod shape, and simultaneously alpha-Al grains are refined, so as to improve usability of the A356.2 aluminum alloy and expand the range of its applications. At present, refiners for the A356.2 aluminum alloy frequently used in industrial production include Al—Ti—B, Al—Ti—C, Al—Ti—B—C and the like.

In the prior art, CN102886511A discloses a method of preparing an Al—Ti—C grain refiner. The refiner is prepared by adding TiC to molten aluminum. The involved TiC is nanoparticles with high cost as a material and complex preparation process. Additionally, it is necessary to use argon or nitrogen to disperse the nanopowder to a melt, which increases the complexity of the process, prolongs the whole process cycle, is difficult to control and does not facilitate industrial production.

In the prior art, CN103667759A discloses an Al—Mg—Si series alloy alpha-Al grain refiner and a preparation method thereof. According to the method, three kinds of power, i.e., Ti powder, Bi powder and Cr powder, need to be mixed, and then the obtained mixture is ground into 200-400 mesh powder, which prolongs the process duration. Additionally, the powder may be used only after the powder is tightly packaged by aluminum foil and baked for 30 minutes at the temperature of 200-250 degrees Celsius, which increases the complexity of the process and does not facilitate industrial production.

In the prior art, CN103589916A discloses a rapid solidification Al—Ti—B—Sc master alloy refiner and a preparation method thereof. The refiner is a crystalline material with a microstructure consisting of alpha-Al as well as micrometer-sized $TiAl_3$, $TiB_2$, $AlB_2$ and $Al_3Sc$ crystal phases. Micrometer-sized precipitated phases provide limited nucleation particles, thus limiting the refinement effect of elements.

In conclusion, the aluminum alloy refiner in the prior art is less likely to be widely applied due to relatively high cost, or the application of the aluminum alloy refiner in production is limited due to complicated using steps and process.

SUMMARY OF THE INVENTION

Therefore, the invention aims at providing a novel method of refining aluminum alloy to overcome the above mentioned problems.

As used in the description of the invention, the term "nanometer quasicrystal alloy" refers to a metal matrix composite material containing nanometer quasicrystal phases. In the invention, the term "nanometer quasicrystal alloy" is an alloy that uses aluminum as a matrix and Al—Mn—Re quasicrystal as precipitated phases.

In order to achieve the above purpose of the invention, the invention provides the following technical solution:

In one aspect of the invention, a method of refining aluminum alloy is provided. This method uses aluminum-based nanometer quasicrystal alloy as an aluminum alloy refiner to refine the aluminum alloy; the aluminum-based nanometer quasicrystal alloy does not comprise Si, Fe or Cr; and the aluminum-based nanometer quasicrystal alloy consists of (1) Al; (2) Mn and (3) La and/or Ce.

In one preferred aspect of the invention, the aluminum-based nanometer quasicrystal alloy comprises 92 parts of Al, 6 parts of Mn and 2 parts of rare earth element by atomic ratio.

In one preferred aspect of the invention, the rare earth element is either Ce or La.

In one preferred aspect of the invention, the aluminum alloy refiner is a pressed columnar test block.

In one preferred aspect of the invention, the method comprises steps of: (1) melting aluminum alloy to be processed; and (2) adding 0.30-0.60% of aluminum alloy refiner, by weight of the aluminum alloy to be processed, to aluminum alloy melt, mechanically stirring, keeping still and deslagging.

In one preferred aspect of the invention, in the step (1), melting temperature of the aluminum alloy is 20-40 degrees Celsius higher than the temperature of the aluminum-based nanometer quasicrystal alloy.

In one preferred aspect of the invention, in the step (2), the aluminum alloy refiner is in an amount of 0.45% by weight of the aluminum alloy to be processed.

In one preferred aspect of the invention, the method is characterized in that the aluminum alloy is A356.2 aluminum alloy.

In another aspect of the invention, the aluminum alloy refined according to the method mentioned above is also provided.

In another aspect of the invention, the application of the aluminum alloy refined according to the method mentioned above in casting wheels is also provided.

The invention also provides the following technical solution:

The technical solution adopted by the invention for solving the technical problem is as follows: a method of grain refinement of A356.2 alloy by using the aluminum-based nanometer quasicrystal alloy comprises the following steps:

Step one, selecting aluminum-based nanometer quasicrystal alloy component.

The selected aluminum-based nanometer quasicrystal alloy should not contain elements such as Si, Fe and Cr which are harmful to mechanical properties of the A356.2 alloy. The selected aluminum-based nanometer quasicrystal may be $Al_{92}Mn_6Ce_2$ composition or $Al_{92}Mn_6La_2$ composition.

Step two, preparing a refiner of the aluminum-based nanometer quasicrystal alloy.

According to the above mentioned composition selection principle, one kind of commercial nanometer quasicrystal alloy ribbon (purchased from Advance Technology & Materials Co., Ltd.) having a purity of not less than 99.99%, a thickness of 20 micrometers and a width of 1.5 mm is selected. A briquetting machine is used for pressing the ribbon for 5 seconds at the pressure of 500 MPa to form columnar test blocks having a size of Ø20 mm*5 mm, thus preventing the ribbon from floating upward in a melting process, and the columnar test blocks are for later use.

Step three, melting and refining process of aluminum alloy.

According to detection results of the aluminum-based nanometer quasicrystal alloy obtained by a differential scanning calorimeter (DSC), melting temperature of the aluminum-based nanometer quasicrystal alloy is analyzed, and melting temperature of the A356.2 alloy is so determined that it is at least 20 degrees Celsius higher than the melting temperature of the aluminum-based nanometer quasicrystal alloy, but is not lower than 720 degrees Celsius (i.e., the usual melting temperature of the A356.2 alloy), ensuring the successful melting of the A356.2 aluminum alloy after being added to the aluminum-based nanometer quasicrystal alloy. After the A356.2 alloy is melted, add 0.45% by weight of aluminum-based nanometer quasicrystal alloy columnar test blocks to A356.2 aluminum alloy melt, mechanically stir for 120 seconds so as to fully melt and uniformly disperse the test blocks, keep the alloy melt still for 10 minutes, deslag and cast.

The invention has the beneficial effects that: the aluminum-based alloy used for refining the A356.2 alloy in the invention is nanometer quasicrystal alloy and has the characteristic of composition uniformity; after being added to the aluminum alloy melt, a large number of nanometer quasicrystal phases can uniformly disperse in molten aluminum as heterogeneous nucleation cores; the sizes of alpha-Al grains in the refined A356.2 alloy are significantly reduced in comparison with the sizes of grains in the aluminum alloy treated by using a traditional refiner, and the refinement effect is better. The method is relatively simple in technological process, is short in production cycle, and overcomes the disadvantages of complicated process, long process time, limited refinement effect and the like in melting and preparation processes. The preparation process of the refiner described in the method is so simple that the commercially available ribbon can be used simply by pressing it into blocks, and therefore, the working time is short, and the production efficiency is high. In the invention, the rare earth-containing alloy which has strong refinement ability on the A356.2 alloy is used as the refiner, and the refiner is nanometer quasicrystal; after the rare earth-containing alloy is added to the melt, the element distribution of the rare earth-containing alloy is more uniform than that of traditional alloy; and the nanometer quasicrystal particles substantially increase the quantity of heterogeneous nucleation particles and improve the grain refinement effect of the aluminum alloy.

BRIEF DESCRIPTION OF THE DRAWINGS

Hereinafter, the embodiments of the invention are described in details below with reference to the accompanying drawings, wherein.

DETAILED DESCRIPTION OF THE INVENTION

Embodiment 1 $Al_{92}Mn_6Ce_2$ Nanometer Quasicrystal Alloy is Used as the Refiner Step one, selecting aluminum-based nanometer quasicrystal alloy composition.

The selected aluminum-based nanometer quasicrystal alloy should not contain elements such as Si, Fe and Cr which are harmful to properties of A356.2 alloy. This embodiment selects the $Al_{92}Mn_6Ce_2$ nanometer quasicrystal alloy composition.

Step two, preparing a refiner of the aluminum-based nanometer quasicrystal alloy.

Figure 1:
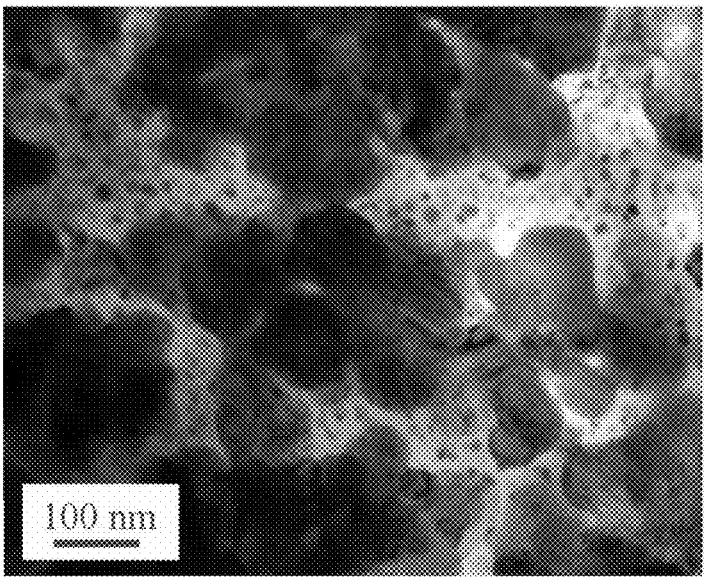
FIG. 1 is a transmission electron micrograph of $Al_{92}Mn_6Ce_2$ nanometer quasicrystal alloy in embodiment 1.
Figure 2:
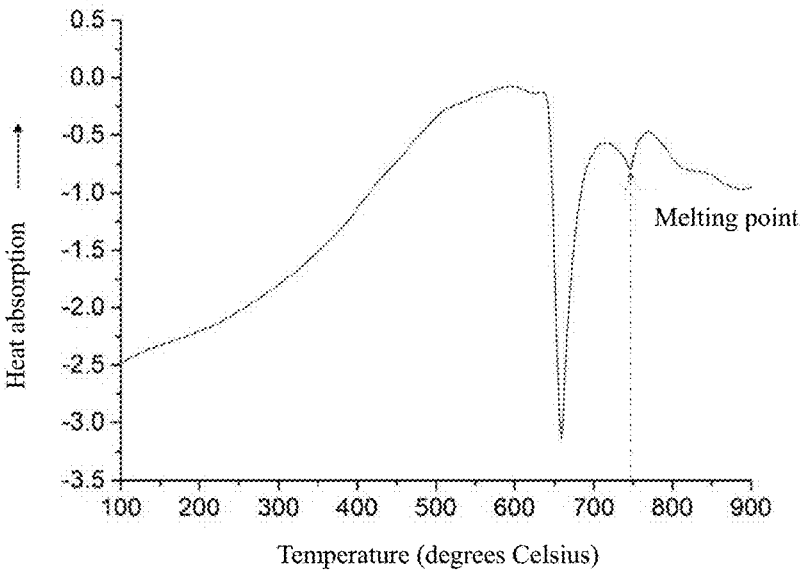
FIG. 2 is a differential scanning calorimetric curve of $Al_{92}Mn_6Ce_2$ nanometer quasicrystal alloy in the embodiment 1.

According to the above composition selection principle, a kind of commercial nanometer quasicrystal alloy ribbon (purchased from Advance Technology & Materials Co., Ltd.) having a purity of not less than 99.99%, a thickness of 20 micrometers and a width of 1.5 mm is selected, and this alloy shown in FIG. 1 contains a large number of Al—Mn—Ce nanometer quasicrystal particle phases. The briquetting machine is used for pressing the ribbon for 5 seconds at the pressure of 500 MPa to form columnar test blocks having a size of Ø20 mm*5 mm, thus preventing the ribbon from floating upward in melting process, and the columnar test blocks are for later use.

Step three, determining melting temperature of aluminum alloy and carrying out the melting process.

According to detection results of the aluminum-based nanometer quasicrystal alloy obtained by the differential scanning calorimeter (DSC), the melting temperature of the aluminum-based nanometer quasicrystal alloy is analyzed to be approximately 748 degrees Celsius, and the melting temperature of the A356.2 alloy is so determined that it is at least 20 degrees Celsius higher than the melting temperature of the aluminum-based nanometer quasicrystal alloy, but is not lower than 720 degrees Celsius (i.e., the usual melting temperature of the A356.2 alloy), ultimately the melting temperature of the aluminum alloy is determined to be 770 degrees Celsius, ensuring the successful melting of the A356.2 aluminum alloy after being added to the aluminum-based nanometer quasicrystal alloy. After the A356.2 alloy is melted, add 0.45% (the first group of tests) by mass fraction of aluminum-based nanometer quasicrystal alloy columnar test blocks to A356.2 aluminum alloy melt, mechanically stir for 120 seconds so as to fully melt and uniformly disperse the test blocks, keep the alloy melt still for 10 minutes, deslag and cast. At the same time, 0.30% of refiner and 0.60% of refiner, respectively recorded as the second group of tests and the third group of tests, are also used for testing.

Figure 3:
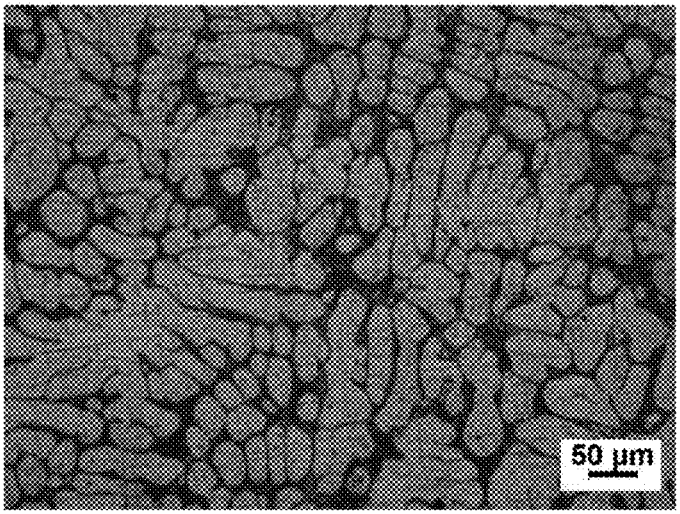
FIG. 3 is an as-cast microstructure of A356.2 alloy.

FIG. 3 is an as-cast metallographic microstructure of A356.2 alloy (which contains 6.83% of Si, 0.33% of Mg, 0.07% of Fe, 0.08% of Ti, 0.023% of Sr, 0.0008% of B and the balance Al and is purchased from Binzhou Mengwei Lianxin New Material Co., Ltd.). As shown in FIG. 3, alpha-Al grains in the as-cast microstructure of the A356.2 aluminum alloy are relatively coarse, and the average grain size is 127.3 μm.

Figure 4:
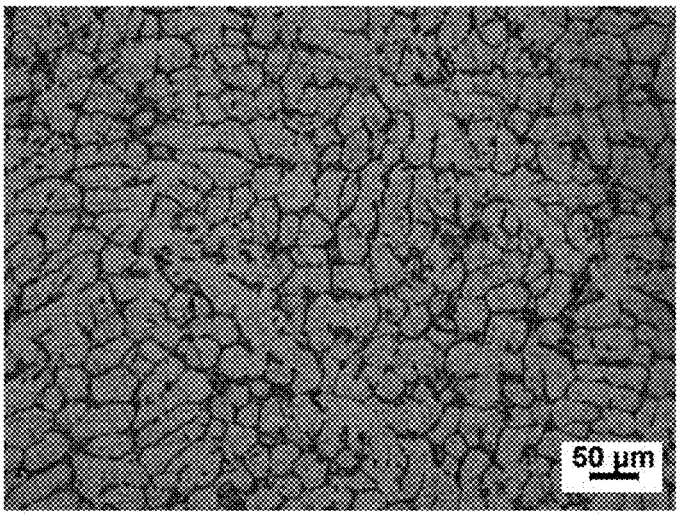
FIG. 4 is an as-cast microstructure of A356.2 alloy treated by the traditional Al—Ti—B refiner.

FIG. 4 is an as-cast microstructure of the alloy obtained by adding 0.25% by mass fraction of traditional as-cast Al-5Ti-1B refiner to the A356.2 aluminum alloy. As shown in FIG. 4, alpha-Al grains after such treatment are refined, and the average grain size is 71.8 μm.

Figure 5:
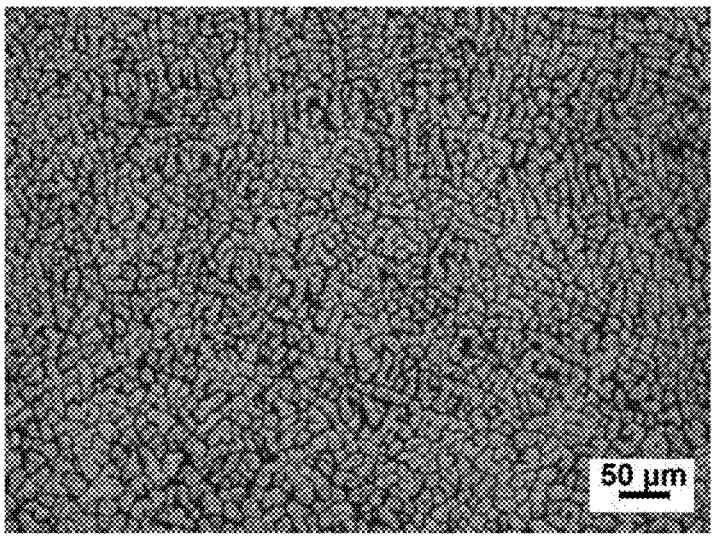
FIG. 5 is an as-cast microstructure of A356.2 alloy treated by $Al_{92}Mn_6Ce_2$ nanometer quasicrystal alloy.

The result of the first group of tests is shown in FIG. 5 which is an as-cast microstructure of the alloy obtained by adding 0.45% by mass fraction of $Al_{92}Mn_6Ce_2$ nanometer quasicrystal alloy columnar test blocks to the A356.2 aluminum alloy. As shown in FIG. 5, alpha-Al grains after such treatment are further refined, and the average grain size is 28.7 μm. It can be seen that the refinement effect prepared in this embodiment by adding the aluminum-based nanometer quasicrystal alloy ribbon columnar test blocks to the A356.2 alloy is better than the refinement effect achieved by adopting the traditional as-cast refiner.

Test samples obtained by the second group of tests and the third group of tests are also subjected to alloy as-cast microstructure test. The results show that alpha-Al grains after treatment are further refined, and the average grain size is respectively 31.5 μm and 28.2 μm, which also shows that the aluminum alloy refiner of the invention is more effective than the traditional as-cast refiner.

Embodiment 2 $Al_{92}Mn_6La_2$ Nanometer Quasicrystal Alloy is Used as the Refiner Step one, selecting aluminum-based nanometer quasicrystal alloy composition.

The selected aluminum-based nanometer quasicrystal alloy should not contain elements such as Si, Fe and Cr which are harmful to properties of A356.2 alloy. This embodiment selects $Al_{92}Mn_6La_2$ nanometer quasicrystal alloy composition.

Step two, preparing aluminum-based nanometer quasicrystal alloy refiner.

According to the above mentioned composition selection principle, a kind of commercial nanometer quasicrystal alloy ribbon (purchased from Advance Technology & Materials Co., Ltd.) having a purity of not less than 99.99%, a thickness of 20 micrometers and a width of 1.5 mm is selected, and the alloy contains a large number of Al—Mn—La nanometer quasicrystal particle phases. The briquetting machine is used for pressing the ribbon for 5 seconds at the pressure of 500 MPa to form columnar test blocks having a size of Ø20 mm*5 mm, thus preventing the ribbon from floating upward in melting process, and the columnar test blocks are for later use.

Step three, determining melting temperature of aluminum alloy and carrying out the melting process.

According to detection results of the aluminum-based nanometer quasicrystal alloy obtained by the differential scanning calorimeter (DSC), melting temperature of the aluminum-based nanometer quasicrystal alloy is analyzed to be approximately 770 degrees Celsius, and the melting temperature of the A356.2 alloy is so determined that it is at least 20 degrees Celsius higher than the melting temperature of the aluminum-based nanometer quasicrystal alloy, but is not lower than 720 degrees Celsius (i.e., the usual melting temperature of the A356.2 alloy), ultimately the melting temperature of the aluminum alloy is determined to be 790 degrees Celsius, ensuring the successful melting of the A356.2 aluminum alloy after being added to the aluminum-based nanometer quasicrystal alloy. After the A356.2 alloy is melted, adding 0.45% (the fourth group of tests) by mass fraction of aluminum-based nanometer quasicrystal alloy columnar test blocks to the A356.2 aluminum alloy melt, mechanically stir for 120 seconds so as to fully melt and uniformly disperse the test blocks, keep the alloy melt still for 10 minutes, deslag and cast. At the same time, 0.30% of refiner and 0.60% of refiner, respectively recorded as the fifth group of tests and the sixth group of tests, are also used for testing.

Test samples in the fourth group to the sixth group are subjected to alloy as-cast microstructure testing. The results show that alpha-Al grains after treatment are further refined, and the average grain sizes are respectively 31.8 μm, 33.2 μm and 29.9 μm, which also shows that the aluminum alloy refiner of the invention is more effective than the traditional as-cast refiner.

Raw materials and devices used in the above mentioned embodiments are obtained by known approaches, and the adopted operation technology can be mastered by those skilled in the art.

The invention claimed is:

1. A method of refining an aluminum alloy, comprising:

melting the aluminum alloy to be processed;

adding 0.30%-0.60% of aluminum alloy refiner, by weight of the aluminum alloy to be processed, to the aluminum alloy as melted;

mechanically stirring the aluminum alloy as melted; and after mechanically stirring the aluminum alloy as melted, deslagging the aluminum alloy, wherein the aluminum alloy refiner is an aluminum-based nanometer quasicrystal alloy; and the aluminum-based nanometer quasicrystal alloy consists of (1) Al; (2) Mn, and (3) La and/or Ce, and the aluminum alloy is A356.2 aluminum alloy.

2. The method of claim 1, wherein the aluminum-based nanometer quasicrystal alloy comprises 92 parts of the Al, 6 parts of the Mn and 2 parts of the La and/or Ce by atomic ratio.

3. The method of claim 1, wherein the aluminum alloy refiner is pressed columnar test blocks.

4. The method of claim 1, wherein a melting temperature of the aluminum alloy is 20 to 40 degrees Celsius higher than temperature of the aluminum-based nanometer quasicrystal alloy.

5. The method of claim 1, wherein the aluminum alloy refiner is added in an amount of 0.45% by weight of the aluminum alloy refiner to be processed.

* * * * *